United States Patent [19]

Kleid

[11] 3,980,295

[45] Sept. 14, 1976

[54] SKEW ELIMINATING SHEET FEEDING MECHANISM

[75] Inventor: Robert E. Kleid, Fairfield, Conn.

[73] Assignee: Pitney-Bowes, Inc., Stamford, Conn.

[22] Filed: Jan. 13, 1975

[21] Appl. No.: 540,524

[52] U.S. Cl. ..... 271/242; 271/272

[51] Int. Cl.[2] ..... B65H 9/00; B65H 5/06

[58] Field of Search ..... 271/242, 243, 227, 226, 271/228, 272, 273, 274

[56] References Cited

UNITED STATES PATENTS

| | | | |
|---|---|---|---|
| 2,214,751 | 9/1940 | Pierce | 271/242 X |
| 2,656,186 | 10/1953 | Rosenburgh | 271/227 |
| 3,240,487 | 3/1966 | Templeton | 271/228 |

*Primary Examiner*—Evon C. Blunk
*Assistant Examiner*—Bruce H. Stoner, Jr.
*Attorney, Agent, or Firm*—William D. Soltow, Jr.; Albert W. Scribner; Martin D. Wittstein

[57] ABSTRACT

The side portions of a sheet are fed equally and in synchronism with its central portion so that when any side portion of a skewed sheet leads the central portion along the path of movement of the sheet said side portion will be held back until the central portion begins its feeding movement thereby eliminating skew in the sheet. The mechanism includes a drive shaft supporting a central drive roller secured thereon and idle rollers spaced to either side of the drive roller, and a driven shaft supporting a series of rollers secured thereto in opposition to the rollers on the drive shaft, the drive roller and its opposing roller being out of contact with one another but capable of contacting a sheet introduced therebetween, the idle rollers contacting their respective opposing rollers.

6 Claims, 3 Drawing Figures

SKEW ELIMINATING SHEET FEEDING MECHANISM

The present invention relates to the feeding of a flat sheet along a path, and more particularly relates to eliminating any skew in the sheet as it is fed along its path. A rectangular sheet to be fed has a leading edge that is desired to be maintained perpendicular to the path of the sheet. If this edge is not perpendicular, then the sheet is skewed, i.e., not perpendicular with its path of movement and may cause malfunctioning, erratic operation or other undesirable results in those downstream devices to which it is introduced.

While it has heretofore been suggested to eliminate skew in a sheet feeding mechanism such devices have generally relied on the use of an aligning surface that is parallel to the path. The longitudinal side edge of the sheet is here urged against the surface in order to twist or turn the sheet to eliminate any skew which the sheet may have. Though such devices have been operable, they generally require a longer path in order to accommodate the aligning surface, additional linkage, etc., all of which tends to increase the cost and complexity of sheet feeding or transporting devices.

It is accordingly an object of the present invention to provide a sheet feeding mechanism in which skew is eliminated without the use of an aligning surface for the side edges of the sheet.

Another object of the present invention is to achieve skew elimination in a structure that essentially included only sheet feeding components for imparting path movement to a sheet.

A further object of the present invention is to achieve the above objects with the assurance that the leading edge of a sheet is in a desired position with respect to the path of movement of the sheet before feeding of the sheet is initiated by the feeding mechanism.

Still another object of the present invention is to achieve the above objects with a sheet feeding mechanism which is economical in construction, requires substantially no elongation of the sheet feed path to effect skew elimination and which is reliable and durable in use.

In carrying out the present invention, the feeding mechanism feeds a sheet along a path by frictional engagement of the sheet between three pairs of feed rolls spaced transversely across the path. One pair of rolls is positioned at each side portion of the sheet while a central pair is positioned to engage the central portion of the sheet. The rolls are interconnected to a drive source in a manner that causes the central rolls to feed the sheet only when a sheet is located between its bite while the two pairs of outer rolls are moved only in synchronism with the feeding of the central rolls. The outer rolls are incapable of feeding the side portions of the sheet until the central portion of the sheet is driven or fed and then the side rolls feed the sheet equally and concurrently with the feeding of the central portion of the sheet by the central rolls.

A sheet which has a linear leading edge and is skewed with respect to its path of movement, would have one side portion of its leading edge disposed forwardly of the central portion leading edge and along the path. As the leading edge engages the feeding mechanism of the present invention, the forward side portion will engage a non-feeding pair of outer rolls and thereby be prevented from moving past the feed mechanism. The sheet is continuing its movement along its feed path will then either slightly buckle or be twisted or turned to a non-skewed position until its central portion leading edge enters the bite of the central rolls. The central rolls then begin to feed the sheet and also simultaneously cause the outer pair of rolls to be driven so as to equally feed the outer portions of the sheet in the feed direction. Hence the sheet can begin to pass through the various feed rolls of the feed mechanism only when its leading edge is perpendicular to its path which thereby eliminates any skew which the sheet may have had when it encountered the feeding mechanism herein disclosed.

Other features and advantages will hereinafter appear.

Figure 1:
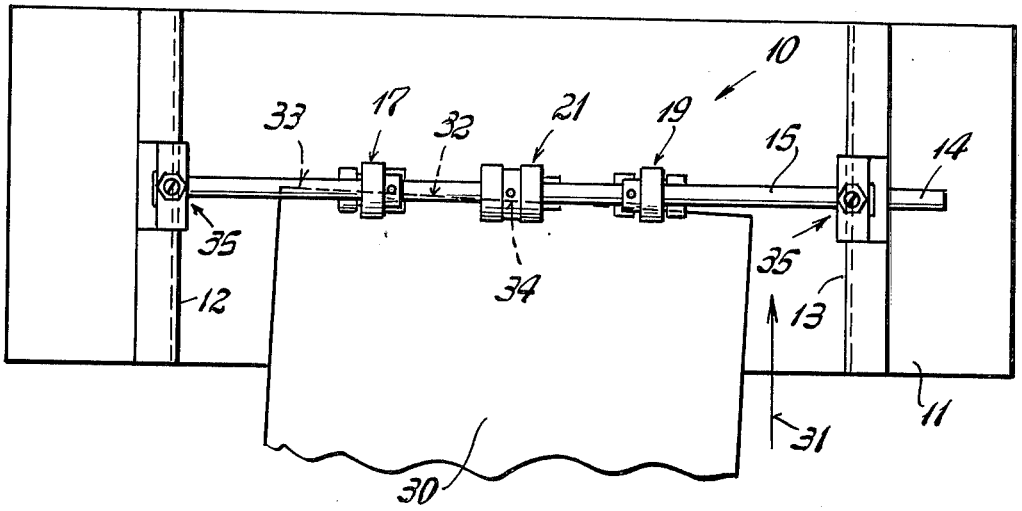
FIG. 1 is a plan of the skew eliminating sheet feeding mechanism of the present invention.
Figure 2:
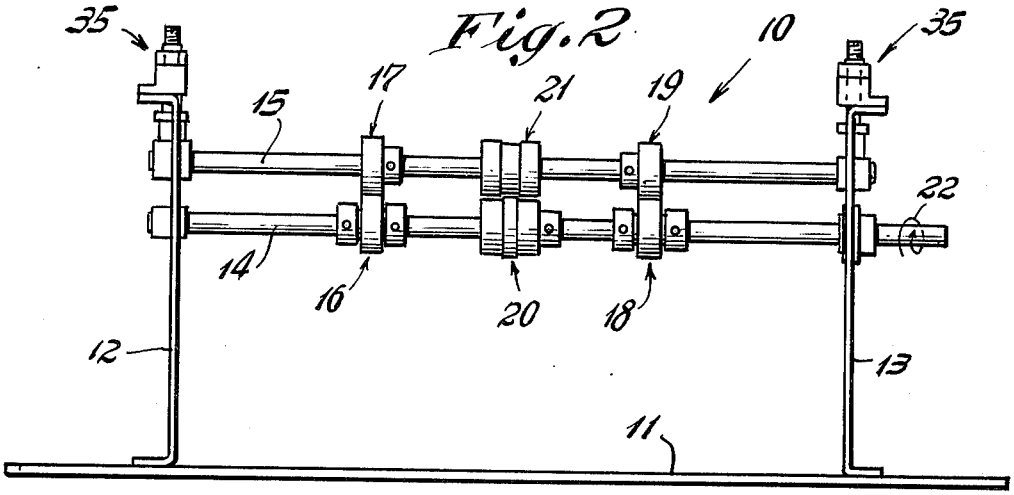
FIG. 2 is a front elevation of the apparatus of FIG. 1.

Referring to the drawings, the skew eliminating sheet feeding mechanism of the present invention is generally indicated by the reference numeral 10 and is shown mounted on a base 11 having uprights 12 and 13 secured thereto. A lower shaft 14 is journaled between the uprights as is a parallel upper shaft 15.

The shafts carry three pairs of feed rolls with one outer pair of feed rolls being indicated by the reference numerals 16 and 17 and another corresponding outer pair by reference numerals 18 and 19. Located between the outer rolls is a pair of central feed rolls 20 and 21.

Figure 3:
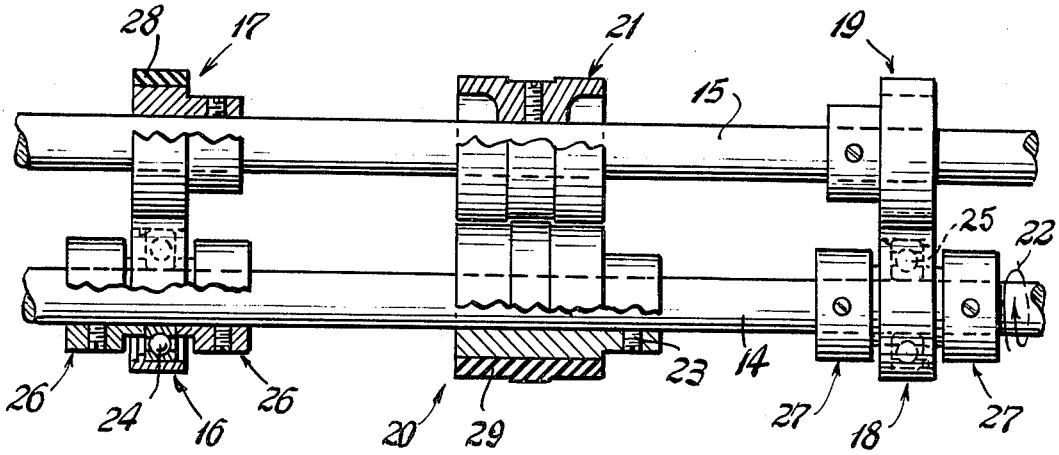
FIG. 3 is a partial elevational view with portions broken away to illustrate the structural aspects of the present invention.

As shown in FIG. 3, the shaft 14 is continuously rotated as indicated by an arrow 22 by any appropriate drive means and the roll 20 is secured to the shaft, as by a set screw 23, for rotation therewith. The rolls 16 and 18 are each rotatably supported on the shaft by way of ball bearings 24 and 25, respectively, so that they are free to rotate with respect to the shaft 14 and hence are merely idly supported thereon. Collars 26 for roll 16 and 27 for roll 18 maintain the rolls in their selected axial positions on the shaft.

The upper shaft 15 is mounted in the uprights 12 and 13 for free rotation and the three rolls 17, 19 and 21 carried thereby are each secured to the shaft 15 by a set screw as shown.

Each of the pairs of rolls are dimensioned so that upon rotation they each feed or move equally the portion of the sheet which they encounter and thus may have, as shown, all the same effective diameter. Further, rolls 17 and 19, preferably have a frictional and resilient outer covering such as indicated by the reference numeral 28 for the roll 17 with the covering having a cylindrical periphery. The periphery of the rolls 20 and 21 are preferably shaped with a slight, cooperating tongue and groove configuration with the lower roll 20 having a frictional and resilient covering 29.

The shafts 14 and 15 are supported in the uprights 12 and 13 in a position that causes a slight spacing to exist in the bite between the central rolls 20 and 21 so that there is a lack of driving engagement therebetween. However, the spacing is such that when a sheet is positioned in the bite, a frictional driving engagement is effected through the sheet from the roll 20 to the roll 21. The mutually contacting outer rolls assure that the sheet will not pass therebetween without rotation of the rolls. With this arrangement rotation of the shaft 14 drives the roll 20 while all the other rolls remain stationary absent a sheet between the rolls 20 and 21; the frictional resistance of shaft 15 to turn in its journals here being greater than the frictional torque of shaft 14 on rollers 16 and 18 (through ball bearings 24 and 25) which would tend to cause rollers 16 and 18 to turn. When a sheet is located between the central rolls all rolls will rotate.

Referring to FIG. 1, when it is desired to move a sheet 30 along a feed path 31 that is perpendicular to the shafts 14 and 15, which sheet 30 has a straight leading edge 32, and where the sheet is skewed, as indicated in FIG. 1, the left side 33 of the leading edge is the most forward portion and thus encounters the feeding mechanism 10 first. Side 33 will abut against the stationary outer pair of rolls 16 and 17 and be prevented from further movement along the path. However, sheet 30 continues to be driven along the said feed path by a prior feeding mechanism (not shown) in the path, as for example by a conveyor belt, and if the sheet has sufficient rigidity and freedom of movement it will be thereby twisted or turned about its point of engagement with the outer rolls 16 and 17 and cause the central leading edge portion 34 to become aligned with the shafts and hence perpendicular to the path of movement. The central portion 34 thus may enter the bite of the central rolls 20 and 21, aided by the peripheral configuration and frictional covering of the central rolls which causes the continuous driven roll 20 to effect rotation of the roll 21. The shaft 15 is thus rotated driving both pairs of outer rolls. The three pairs of rolls now feed the side and central portions of the sheet equally and will eject the sheet from the feeding mechanism, any skew which the sheet had when it encountered the feeding mechanism being thus effectively eliminated.

While the left side edge 33 has been referred to, it will be clear that if the sheet is skewed in the other direction, i.e., with the right edge in a lead condition, then the rolls 18 and 19 will serve as the initial abutment and cause the sheet to be twisted in the other direction (clockwise as seen in FIG. 1) to eliminate such skew.

The disclosed embodiment obviates skew in either direction. If all sheets presented to the feeding mechanism are only skewed in one direction, then it may be desirable to eliminate one pair of outer rolls and position the central roll to engage the side portion which has the lagging portion of the leading edge.

In some instances where a prior feeding mechanism is positively feeding the sheet at the time it engages the feeding mechanism 10, the sheet rather than being turned to become in alignment with the path of the movement may accommodate the holding of the leading edge until it is perpendicular to the path of movement by a slight buckling of the sheet.

The feeding mechanism preferably has adjusting means 35 mounted on each upright to enable vertical positioning of the shaft 15 with respect to shaft 14.

It will accordingly be understood that there has been disclosed a sheet feeding mechanism which is capable of not only feeding a sheet along a path but which also eliminates skew which may be present in the sheet when it is introduced to the feeding mechanism. As the leading edge of a skewed sheet approaches the feeding mechanism, feeding of the sheet is prevented until the leading edge is properly aligned with the feeding mechanism, a process which eliminates skew and permits the feeding mechanism to thereafter advance all portions of the sheet equally thereby assuring that the sheet as it leaves the feeding mechanism will be properly oriented in the feed path.

Variations and modifications may be made within the scope of the claims and portions of the improvements may be used without others.

What is claimed is:

1. A skew eliminating sheet feeding mechanism comprising first means adapted to engage a portion of a sheet to advance a sheet along a path, the first means including a pair of feed rolls, one of which is a drive roll and the other of which is a driven roll, the feed rolls of the first means being spaced to be frictionably engagable only with a portion of a sheet disposed therebetween, second means adapted to engage another portion of the sheet to advance it along the path, the second means including a pair of cooperating feed rolls in frictional driving interengagement, means for rotatably interconnecting one of the feed rolls of the second means with the driven feed roll of the first means to cause the second means to only advance the sheet equally and in synchronism with the first means when a portion of a sheet is disposed between the drive feed roll and the driven feed roll of the first means, whereby both the first and second means initiate feeding the sheet simultaneously.

2. The invention as defined in claim 1 in which the first and second means are positioned to be perpendicular to the path of movement of a sheet.

3. The invention as defined in claim 1 in which there is a third means adapted to engage another portion of the sheet to advance it along the path, the third means including a pair of cooperating feed rolls in frictional driving interengagement, and in which the interconnecting means connects one of the feed rolls of the third means with the driven feed roll of the first means to cause the first, second, and third means to only advance the sheet equally and in synchronism.

4. The invention as defined in claim 3 in which the first means is positioned to engage a central portion of the sheet, in which the second means is positioned to engage a portion of the sheet along one side thereof and the third means is positioned to engage the other side portion of the sheet.

5. The invention as defined in claim 3 in which there are means for continuously rotating the drive roll of the first means and in which the interconnecting means mechanically secures the driven roll of the first means with a roll of each of the second and third means.

6. A skew eliminating sheet feeding mechanism comprising a first shaft having a central drive roll secured thereon, means for rotating the first shaft, an outer roll mounted for idle motion on the first shaft on each side of the central roll, a second shaft mounted for rotation and parallel with the first shaft and having a central driven roll secured thereto, an outer roll mounted on the second shaft for rotation therewith on each side of the central driven roll, said central rolls being opposed and each one of said outer rolls on each shaft being opposite an outer roll on the other shaft, the mutual engagement of the opposed outer rolls serving to mutually space the peripheries of said central rolls, said central rolls only being frictionally engageable with a portion of a sheet positioned therebetween, whereby an outer portion of a skewed sheet that is forward of the central portion of the sheet is prevented from being fed until the central portion of the sheet is disposed between the central rolls.

* * * * *